US005537744A

United States Patent [19]

Hirose

[11] Patent Number: 5,537,744

[45] Date of Patent: Jul. 23, 1996

[54] TAPPET FOR AN IC ENGINE

[75] Inventor: Masahito Hirose, Hayama-cho, Japan

[73] Assignee: Fuji Oozx, Inc., Japan

[21] Appl. No.: 422,077

[22] Filed: Mar. 10, 1995

[30] Foreign Application Priority Data

Sep. 21, 1994 [JP] Japan ..... 6-226299

[51] Int. Cl.[6] ..... B23P 15/00

[52] U.S. Cl. ..... 29/888.43; 123/90.51

[58] Field of Search ..... 29/888.43, 428; 123/90.51

[56] References Cited

U.S. PATENT DOCUMENTS

| | | | |
|---|---|---|---|
| 3,683,876 | 8/1972 | Lesher | 123/90.51 |
| 4,230,491 | 10/1980 | Behnke | 123/90.51 |
| 4,768,476 | 9/1988 | Behnke et al. | 29/888.43 |
| 4,852,531 | 8/1989 | Abkowitz et al. | 123/90.51 |
| 4,873,150 | 10/1989 | Doi et al. | 123/90.51 |
| 5,001,019 | 3/1991 | Ito et al. | 123/90.51 |
| 5,060,607 | 10/1991 | Taniguchi | 123/90.51 |
| 5,168,841 | 12/1992 | Suzuki et al. | 29/888.43 |
| 5,226,977 | 7/1993 | Kitaguchi et al. | 123/90.51 |

*Primary Examiner*—Irene Cuda
*Attorney, Agent, or Firm*—Graham & James

[57] ABSTRACT

A tappet in a direct acting type valve operating mechanism of an internal combustion engine comprises a top wall and a cylindrical portion. The upper and lower surfaces of the top wall contacts a rotary cam and the end of a stem of an engine valve respectively. A hard metal layer is formed at the upper and lower surfaces of the top wall to increase strength thereof, thereby increasing wear resistance and durability of the tappet.

3 Claims, 4 Drawing Sheets

TAPPET FOR AN IC ENGINE

BACKGROUND OF THE INVENTION

The present invention relates to tappet in use for a direct acting type valve operating mechanism in an internal combustion engine.

In FIG. 7, "A" denotes a conventional tappet in use for a direct acting type valve operating mechanism in an internal combustion engine. The tappet "A" comprises a cylinder closed by a top wall 22 at the upper end, and in the middle of the lower surface of the top wall 22, there is integrally formed a projection 23 which contacts the end of a stem of an engine valve (not shown). The tappet "A" is generally molded by cold forging of low carbon mild steel, and is then subjected to heat treatment such as cementation and hardening.

However, when the conventional tappet "A" as above is subjected to heat treatment such as cementation and hardening, thermal expansion occurs, thereby decreasing accuracy in size of each portion, which involves high cost for mechanically cutting and processing. Further, it requires a number of mechanical processing steps which is troublesome, thereby decreasing productivity.

In the top wall of the tappet "A" which is molded from mild steel, there is low strength at the lower surface which contacts the end of the stem of the engine valve and at the upper surface which contacts a rotary cam even though each portion is strengthened with cementation and hardening. Thus, compression load repeatedly acts up and down to each portion, thereby deforming it locally and increasing wear rate.

SUMMARY OF THE INVENTION

According to the present invention, to overcome the disadvantages, it is an object to provide a tappet in an internal combustion engine having high wear resistance and durability by increasing strength of the lower and upper surfaces of a top wall.

It is a further object of the present invention to provide a method of manufacturing a tappet which has high wear resistance and durability.

According to one aspect of the present invention, there is provided a tappet in an internal combustion engine, the tappet comprising a top wall and a cylindrical portion, a hard metal layer being provided at lower and upper surfaces of the top wall, the lower surface contacting an end of a stem of an engine valve, the upper surface contacting a rotary cam.

According to another aspect of the present invention, there is provided a method of manufacturing a tappet in an internal combustion engine, the method comprising the steps of filling hard metal powder into a gap in the middle of a die to compress it to form first compressed powder material having a certain thickness; filling soft metal powder onto the first compressed powder material and into an annular gap to compress it to form second compressed powder material which comprises a top wall and a cylindrical portion, the first compressed material being combined to a lower surface of the top wall; filling hard metal powder onto an upper surface of the top wall of the second compressed powder material to compress it; and sintering it to form the tappet.

According to further aspect of the present invention, there is provided a method of manufacturing a tappet by a molding device which comprises a die; a cavity in the die; an upper punch which fits and goes down in the cavity; a first lower punch which fits and goes up in the cavity, opposing the upper punch; a second lower punch which fits and goes down in the first lower punch; and a third lower punch which fits and goes down in the second lower punch, the method comprising the steps of filling hard metal powder into a gap which is formed by lowering the third lower punch in the second lower punch to compress it on the third lower punch by lowering the upper punch to form a lower projection; filling soft metal powder into an annular gap formed by the lowered first lower punch and an inner wall of the cavity and on a top of the second lower punch to compress it by lowering the upper punch and raising the first to third lower punches to form a compressed material which comprises a top wall and a cylindrical portion, the lower projection being combined to a lower surface of the top wall; filling hard metal powder on the top wall of the compressed material to compress it by lowering the upper punch; and sintering it to form the tappet.

According to still further aspect of the present invention, there is provided a method of manufacturing a tappet in an internal combustion engine, filling hard metal powder into a gap in the middle of a die, soft metal powder into a cavity in a die on the hard metal powder, and further hard metal powder onto the soft metal powder to form a three layer powder material; compressing the three layer powder material; and sintering it to form the tappet.

The advantages of the invention are as follows:

a) The hard metal layers are provided on the upper and lower surfaces of the top wall of the tappet body to increase strength thereof, thereby increasing wear resistance and durability.

b) The tappet body is molded by powder metallurgy, so that the composition of powder material is optionally selected, thereby easily manufacturing a tappet having desired properties.

c) The manufacturing process is simplified and accuracy in size is improved, thereby minimizing cost and increasing productivity.

d) The tappet body after sintering still is microporous, thereby increasing oil-maintenance capability and lubricating properties.

BRIEF DESCRIPTION OF THE DRAWINGS

The features and advantages of the present invention will become more apparent based on the following description with respect to appended drawings wherein.

DETAILED DESCRIPTION OF PREFERRED EMBODIMENTS

Figure 1:
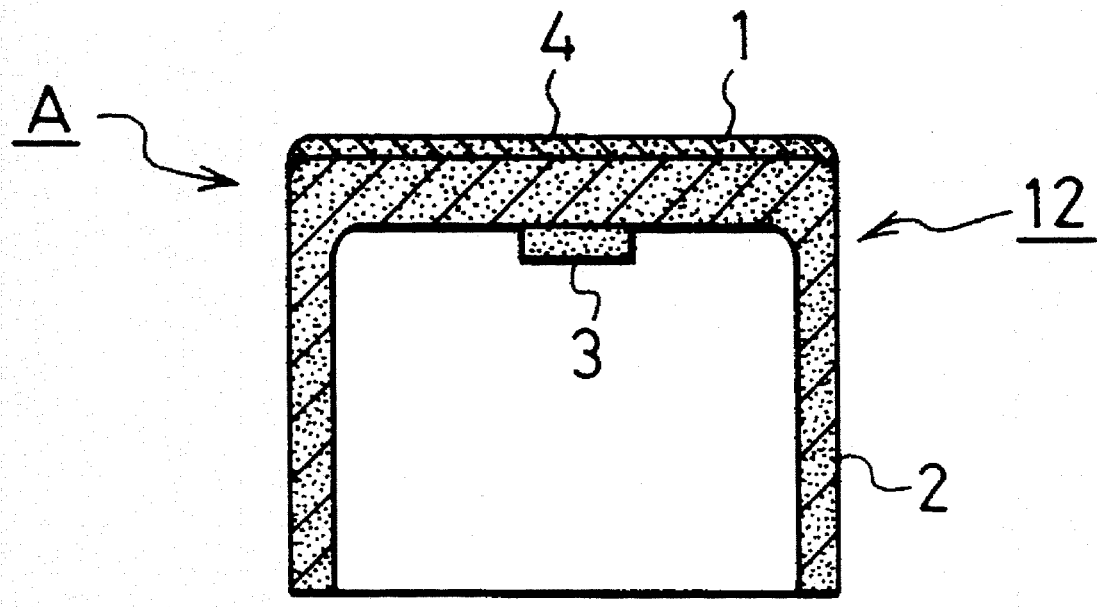
FIG. 1 is a central vertical sectional view of one embodiment of a tappet according to the present invention.

In FIG. 1, a tappet body "A" comprises a top wall 1 and a cylindrical portion 2. In the middle of the lower surface of the top wall 1, there is fixed a smaller diameter rigid metal projection 3 which contacts the end of a stem of an engine valve (not shown).

On the upper surface of the top wall 1, a thinner rigid metal cam receiving plate 4 is fixed. The projection 3 and the cam receiving plate 4 are made of rigid metal such as Fe-C-Cr-Mo-W-V, while the other portions are made of relatively soft metal such as Fe-C.

A method of manufacturing the tappet body "A" will be described with respect to FIGS. 2 to 6 which are central vertical sectional views showing the steps of manufacturing the tappet body "A" in order.

A molding device will be described as below. In the outermost portion of a cavity 6 in a die 5, there is provided a first thinner cylindrical lower punch 7 which has an opening at the top and is slidable up and down. In the first lower punch 7, there is provided a second lower punch 8 which has a guide bore 8*a* on an axis and is slidable up and down. An annular gap "C" between the inner wall of the cavity 6 and a second lower punch 8 is set to have thickness nearly equal to that of the cylindrical portion. In the guide bore 8*a*, a third lower punch 9 is engaged to go up and down. The first to third lower punches 6, 8 and 9 are capable of going up and down separately. 10 denotes an upper punch to be inserted into the cavity 6 and is provided above the die 5 to go up and down.

Figure 2:
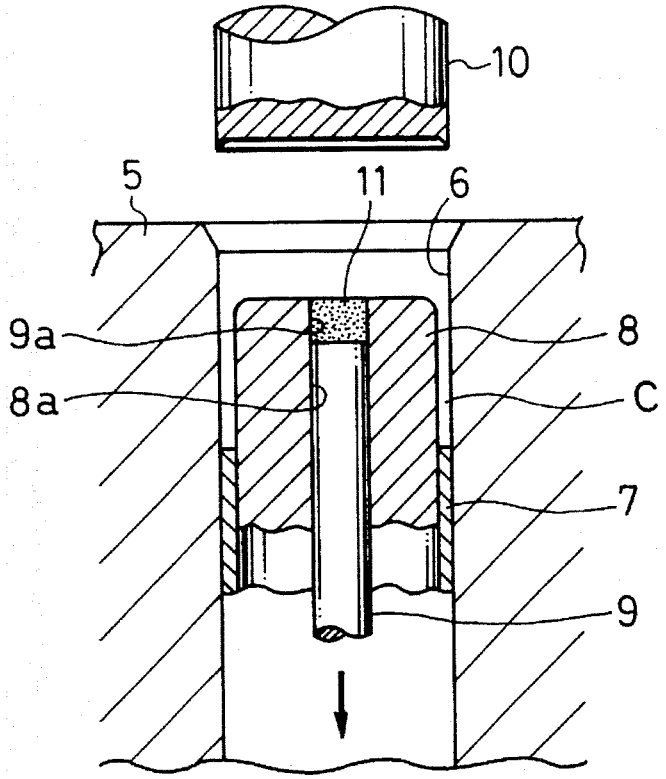
FIG. 2 is a central vertical sectional view which shows the step of manufacturing the tappet according to the present invention, in which hard metal powder for forming a projection is filled.
Figure 3:
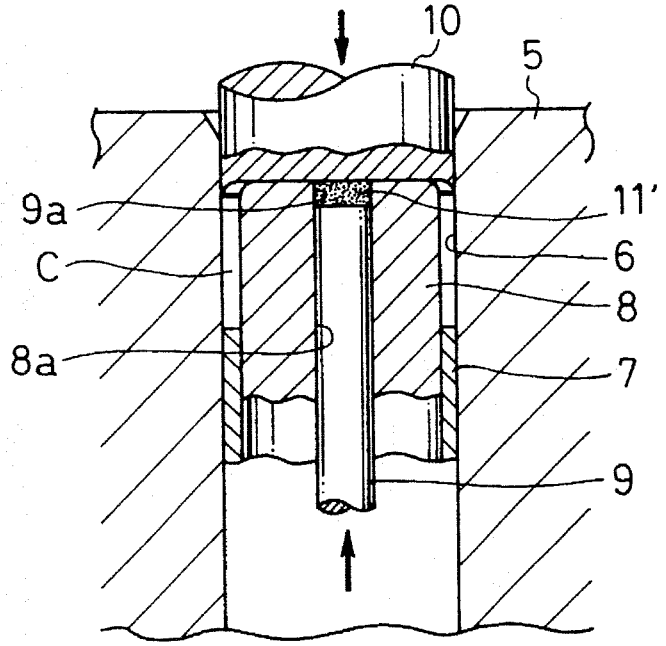
FIG. 3 is a central vertical sectional view in which powder material for the projection is molded.

FIGS. 2 and 3 illustrate the steps in which the projection 3 of the tappet body "A" is formed by compressed powder material. First, as shown in FIG. 2, the third lower punch 9 is lowered to form a gap 9*a* at the top, and hard metal powder 11 made of Fe-C-Cr-Mo-W-V is filled in the gap 9*a*. Then, the upper punch 10 is lowered until it is engaged with the upper end of the second lower punch 8, and at the same time, the third lower punch 9 is raised to compress the metal powder 11, thereby forming a primary compressed powder material 11' somewhat thicker than the projection 3.

Figure 4:
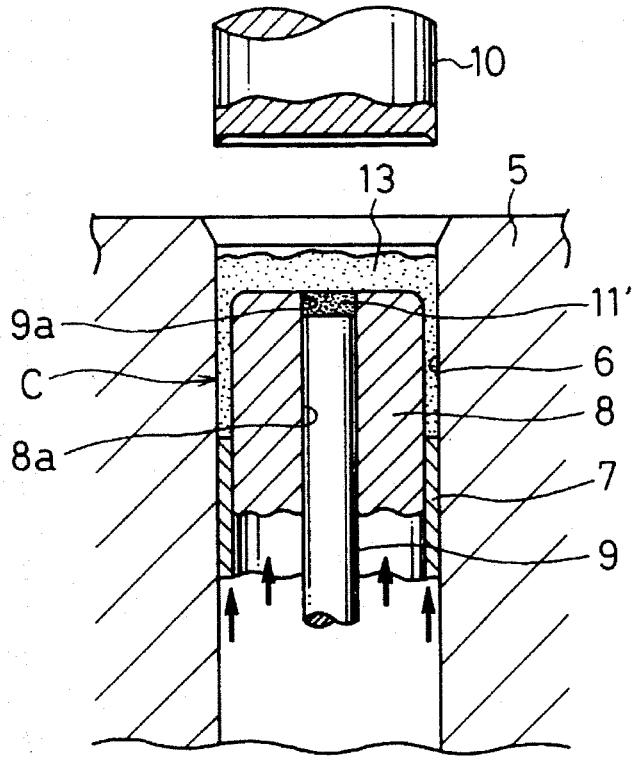
FIG. 4 is a central vertical sectional view in which soft powder material is filled in a gap for forming a cylindrical portion and in a cavity for a top wall.
Figure 5:
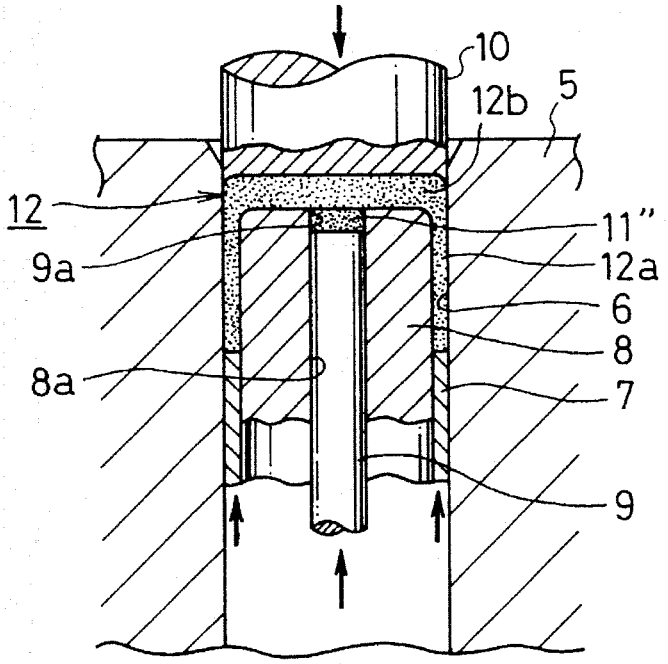
FIG. 5 is a central vertical sectional view in which the soft powder material is compressed to form compressed cylindrical powder material which has a bottom.
Figure 6:
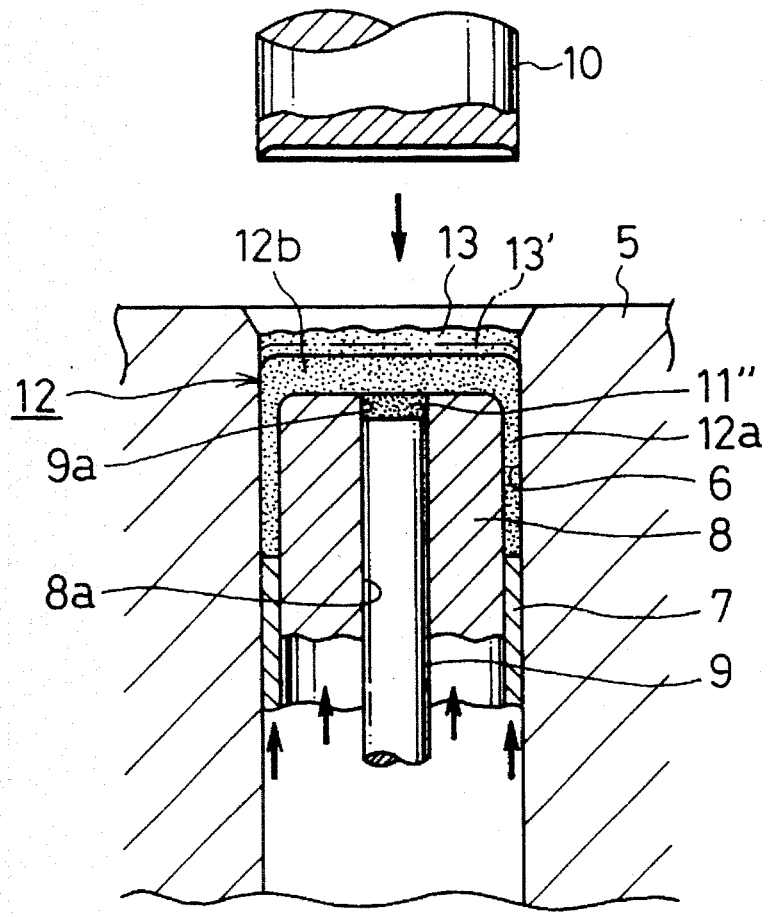
FIG. 6 is a central vertical sectional view which shows the step of filling hard powder material onto the upper surface of the top wall to compress it.
Figure 7:
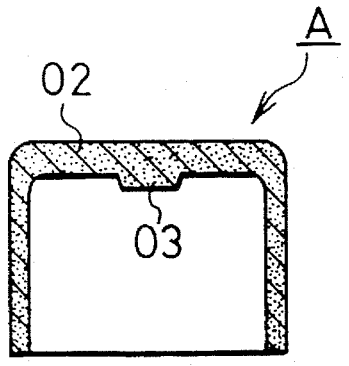
FIG. 7 PRIOR ART
FIG. 7 is a central vertical sectional view which shows a conventional tappet.

As shown in FIG. 4, after the compressed powder material 11' is molded, the upper punch 10 is raised, and soft metal powder 13 made of Fe-C is filled in the annular gap "C" and the cavity 6 on the second lower punch 8. Then, as shown in FIG. 5, the upper punch 10 is lowered, while the first, second and third lower punches 7, 8 and 9 are raised to a certain height to compress the soft metal powder 13, thereby forming compressed powder material which comprises a cylindrical portion 12*a* and a top wall 12*b*. At the same time, the compressed powder material 11' molded in the former step is further compressed to form a secondary compressed powder material 11" which is nearly the same as the projection 3, and the powder material 11' is mounted to the lower surface of the top wall 12*b* of the compressed powder material 12 under pressure.

Then, in the step as shown in FIG. 8, the upper punch 10 is raised to a certain position, and a certain amount of hard metal powder 13 similar to the above is filled onto the upper surface of the compressed powder material 12 in the cavity 8. Then, the upper punch is lowered to compress the metal powder 13, so that thinner compressed powder material 13' having the same form as the cam receiving plate 4 is mounted on the upper surface of the top wall 12*b* under pressure, thereby forming the compressed powder material having a bottom and roughly the same form as the tappet body as shown in FIG. 1. The compressed powder material molded by the foregoing procedures is sintered to form the tappet body "A" as shown in FIG. 1.

The tappet body "A" in the foregoing embodiment has higher strength at the projection 3 which contacts the end of the stem of the engine valve and at the top wall 1 which contacts the rotary cam, thereby providing high wear resistance to increase duration of the tappet body "A".

Powder metallurgy is applied to manufacturing of the tappet body "A", so that strength of essential portions and accuracy in size are increased by selecting powder material, thereby minimizing cost after sintering to increase productivity.

In the tappet body "A" of the foregoing embodiment, the lower surface of the top wall 1 may be flat without the projection 3. In the variation, the top wall 1 comprises three layers in which upper and lower layers are sintered as hard compressed powder layers.

In the foregoing method of manufacturing, compressed powder material similar to the tappet body "A" is formed through a plurality of steps. In FIG. 2, after the hard metal powder 11 is filled, soft powder metal is filled into the upper portion and the gap "C", and hard metal powder is further filled on the filled soft metal powder to form three layers. The metal may be compressed once with upper and lower punches. Also, the first and second punches 7 and 8 may be made integrally with the die 5.

The foregoing merely relates to embodiment of the invention. Various changes and modifications may be made by person skilled in the art without departing from the scope of claims wherein:

What is claimed is:

1. A method of manufacturing a tappet in an internal combustion engine, the method comprising the steps of:

filling hard metal powder into a gap in the middle of a die to compress it to form first compressed powder material having a predetermined thickness;

filling soft metal powder onto the first compressed powder material and into an annular gap to compress it to form second compressed powder material which comprises a top wall and a cylindrical portion, the first compressed material being combined to a lower surface of the top wall;

filling hard metal powder onto an upper surface of the top wall of the second compressed powder material to compress it; and sintering it to form the tappet.

2. A method of manufacturing a tappet by a molding device which comprises a die; a cavity in the die; an upper punch which fits and goes down in the cavity; a first lower punch which fits and goes up into the cavity, opposing the upper punch; a second lower punch which fits and goes down in the first lower punch; and a third lower punch which fits and goes down in the second lower punch, the method comprising the steps of:

filling hard metal powder into a gap by lowering the third lower punch disposed in the second lower punch and compressing the hard metal powder on the third lower punch by lowering the upper punch to form the lower projection;

filling soft metal powder into an annular gap formed by the lowered first lower punch and an inner wall of the cavity and on a top of the second lower punch and compressing the soft metal powder by lowering the upper punch and raising the first to third lower punches to form a compressed material which comprises a top wall and a cylindrical portion, the lower projection being combined to a lower surface of the top wall;

filling hard metal powder on the top wall of the compressed material to compress it by lowering the upper punch; and sintering it to form the tappet.

3. A method of manufacturing a tappet in an internal combustion engine, filling hard metal powder into a gap in a die, soft metal powder into a cavity in a die on the hard metal powder, and further hard metal powder onto the soft metal powder to form a three layer powder material;

compressing the three layer powder material; and sintering it to form the tappet.

* * * * *